United States Patent [19]

Nomura et al.

[11] Patent Number: 4,862,215

[45] Date of Patent: Aug. 29, 1989

[54] IMAGE FORMING APPARATUS

[75] Inventors: Akihiro Nomura, Yokohama; Kiyokazu Namekata, Machida; Mitsuru Kurata, Kawasaki; Takuji Niizawa, Tokyo; Tokihide Ebata, Tokyo; Shinichi Sasaki, Fujisawa, all of Japan

[73] Assignee: Canon Kabushiki Kaisha, Tokyo, Japan

[21] Appl. No.: 285,371

[22] Filed: Dec. 15, 1988

Related U.S. Application Data

[63] Continuation of Ser. No. 183,485, Apr. 15, 1988, abandoned, which is a continuation of Ser. No. 873,535, Jun. 12, 1986, abandoned.

[30] Foreign Application Priority Data

Jun. 15, 1985 [JP] Japan ..... 60-133539

[51] Int. Cl.[4] ..... G03G 15/20; G03G 21/00

[52] U.S. Cl. ..... 355/309; 162/271; 355/284; 355/295

[58] Field of Search ..... 355/3 R, 3 SH, 3 TR, 355/3 FU, 14 TR, 14 FU; 162/270, 271; 271/251; 198/840

[56] References Cited

U.S. PATENT DOCUMENTS

| | | | |
|---|---|---|---|
| 2,461,376 | 2/1949 | Feldmeier | 271/274 |
| 3,879,121 | 4/1975 | Simpson | 355/3 R |
| 3,931,793 | 1/1976 | Kolibas | 355/3 FU X |
| 3,976,370 | 8/1976 | Goel et al. | 355/3 TR |
| 3,981,498 | 9/1976 | Fletcher | 355/3 R X |
| 4,008,955 | 2/1977 | Bar-on | 355/3 R |
| 4,179,117 | 12/1979 | Rhodes | 271/251 |
| 4,188,109 | 2/1980 | Idenawa et al. | 355/3 FU |
| 4,270,443 | 6/1981 | McSwiney et al. | 271/251 X |
| 4,377,229 | 3/1983 | Miyashita | 198/494 |
| 4,419,003 | 12/1983 | Fujie et al. | 355/3 FU |
| 4,572,648 | 2/1986 | Toriumi et al. | 355/3 FU |

FOREIGN PATENT DOCUMENTS 58-22239 2/1983 Japan .

*Primary Examiner*—Fred L. Braun

*Attorney, Agent, or Firm*—Fitzpatrick, Cella, Harper & Scinto

[57] ABSTRACT

An image forming apparatus having an intermediate guide device which is disposed at an intermediate portion between a transfer section and a fixing section for the purpose of guiding a transfer medium while imparting breadthwise tension thereto. This intermediate guide device prevents any wrinkle occurring in the transfer medium near the fixing section from being moved toward the transfer section. In addition, the toner on the transfer medium is prevented from being transferred onto upper-surface rollers of the guide device when the electric charge of the toner leaks to the rollers.

18 Claims, 6 Drawing Sheets

IMAGE FORMING APPARATUS

This application is a continuation of application Ser. No. 183,485 filed Apr. 15, 1988, now abandoned, which was a continuation of Ser. No. 873,535 filed June 12, 1986, also abandoned.

BACKGROUND OF THE INVENTION

1. Field of the Invention

The present invention generally relates to an image forming apparatus such as a copying machine, a printer or the like, and more particularly, to an image forming apparatus in which an intermediate guide means for a flexible, sheet-like transfer medium is disposed at a certain position in a feed passage between a transfer section and a fixing section.

2. Description of the Prior Art

Conventional types of image forming apparatus have been arranged in the following manner. A transferable toner image is formed on the surface of an image carrier which is rotating. A flexible, sheet-like transfer medium which travels in synchronism with the image carrier is brought in close proximity to or in contact with the toner image formed on the surface of the image carrier. After the toner has been transferred to the transfer medium, the medium is separated from the image carrier and is conveyed to a fixing section by given feed means.

Referring to FIG. 7 showing one example of such a conventional type of image forming apparatus, a transfer medium P, such as copying paper, is supplied from a paper feed section (not shown) and is synchronized by a pair of frictional rollers 12 and 13. The thus-synchronized transfer medium P reaches a transfer section through guide means 2 and 2'. In the transfer section, the toner image formed on an image carrier drum 1 is transferred to the transfer medium P by the electric discharge of a transfer charger 3. After completion of the image transfer, the medium P is fed toward a pair of fixing rollers 5*a* and 5*b* by a feed belt 4.

Hitherto, various proposals have been made with respect to a fixing device for fixing a toner image on a transfer medium. In particular, two methods have widely been put into practical use. One is a heat-pressure method in which a pair of rollers are pressed against each other and at least one roller of the pair is heated so as to melt toner, thereby fixing the melted toner to the transfer medium. The other method is a pressure-fixing method in which toner is fixed to a transfer medium under pressure alone, without using any heating means.

In the case of such fixing methods using the above-described roller pair, when the leading end of the transfer medium is inserted into the nip between the fixing roller pair, the load applied to the fixing roller pair is abruptly increased and rotational speed of the fixing roller pair is instantaneously decreased. The force created by the instantaneous decrease in the rotational speed acts to push back the transfer medium and the synchronism between the transfer medium and the image carrier drum becomes unbalanced in the transfer section, so that image formation is adversely affected.

In order to cope with such a problem, one proposal has been made in which intermediate guide means constituted by an upper-surface roller 6*a* and an underside roller 10*a*, as shown in FIG. 7, is disposed at a certain position between the transfer section and the fixing section, and the feed belt 4 is nipped between the rollers 6*a* and 10*a*. According to this construction, when a force acting to push back the transfer medium is generated in the nip between the pair of fixing rollers 5*a* and 5*b*, the force can be absorbed by the slack which is formed in the portion of the transfer medium between the pair of fixing rollers 5*a* and 5*b* and the upper-surface and underside rollers 6*a* and 10*a*.

Specifically, in the pressure-fixing method, the rollers which are pressed against each other are disposed in such a manner that the axes cross each other at a slight angle in order that pressure is uniformly applied to the transfer medium along the entire length of the respective fixing rollers. FIG. 8 shows the state wherein the fixing rollers 5*a* and 5*b* intersect each other at an angle of $\alpha$. In the case of a fixing section constructed in this fashion, the transfer medium P is fed at an angle of $\alpha/2$ degrees with respect to each of the fixing rollers 5*a* and 5*b*. However, since the arrangement shown in FIG. 8 is such that the two rollers 5*a* and 5*b* are respectively shifted $\alpha/2$ degrees from the normal with respect to the direction of travel of the transfer medium P, the transfer medium P is inserted substantially perpendicularly to the nip line where the two rollers are maintained in contact with each other, thereby causing a large impact. Accordingly, the normal arrangement, as shown in FIG. 9, is such that the roller pair is shifted at an angle of $\beta$ as a whole, thus allowing the transfer medium P to be inserted slantwise with respect to the nip line. In the fixing section which is constructed in this manner, the transfer medium P travels in the direction of an arrow B before it is inserted into the nip between the two rollers. However, after the medium P has passed through the nip, it travels in the direction of an arrow C and deviates from the original direction of travel as indicated by the arrow B. In consequence, a wrinkle 9, as shown in FIG. 9, is produced as a result of the unnatural force acting on the transfer medium P. If, as shown in FIG. 10, the upper-surface rollers 6*a* and 6*b* are disposed parallel with each other and with the direction of travel of the transfer medium P, the wrinkle 9 passes in the reverse direction through the space between the upper-surface rollers 6*a* and 6*b*, and one end of the wrinkle 9 reaches the transfer section, with the result that image formation is adversely affected.

In order to prevent the toner on the transfer medium from sticking to the upper-surface rollers 6*a* and 6*b*, one method, as shown in FIG. 11, has been proposed in which an electric field is formed between the upper-surface rollers 6*a* and 6*b* and underside rollers 11*a* and 11*b* by virtue of the application of a bias voltage by means of an electrical power source 7. This method also involves disadvantage in that, if the wrinkle 9 invades the space between the upper-surface rollers 6*a* and 6*b*, the positive charge Q of the toner clinging to the wrinkle 9, for example, leaks to one side 6*b'* of the upper-surface roller 6*b*, and this phenomenon is accompanied by the corresponding toner sticking to the side 6*b'*.

SUMMARY OF THE INVENTION

Accordingly, it is an object of the present invention to provide an image forming apparatus which is capable of eliminating adverse influences on image formation such as would be caused by wrinkling of the transfer medium in the fixing section which might reach the transfer section through the space between the upper-surface rollers serving as intermediate guide means.

It is another object of the present invention to provide an image forming apparatus which is capable of preventing unfixed toner from sticking to the upper-surface rollers.

To these ends, the image forming apparatus in accordance with the present invention comprises:

transfer means for transferring a toner image onto a surface of a flexible, sheet-like transfer medium;

fixing means for fixing the toner image on the transfer medium;

means forming a feed passage which connects the transfer means and the fixing means so as to feed the transfer medium; and intermediate guide means which is disposed at an intermediate position in the feed passage and includes: at least two rollers spaced apart from each other in a direction transverse to the direction from the transfer means to the fixing means. The rollers are maintained in contact with one surface of the transfer medium at a location along the feed passage between the transfer means and the fixing means. Opposite side guide members are maintained in contact with the opposite side of the transfer medium such that the transfer medium is nipped between the rollers and the opposite side guide members. The rollers and the opposite side guide members are arranged to guide the transfer medium while imparting breadthwise tension thereto.

The above and other objects, features and advantages of the present invention will become apparent from the following description of preferred embodiments thereof, taken in conjunction with the accompanying drawings.

DESCRIPTION OF THE PREFERRED EMBODIMENTS

Figure 1:
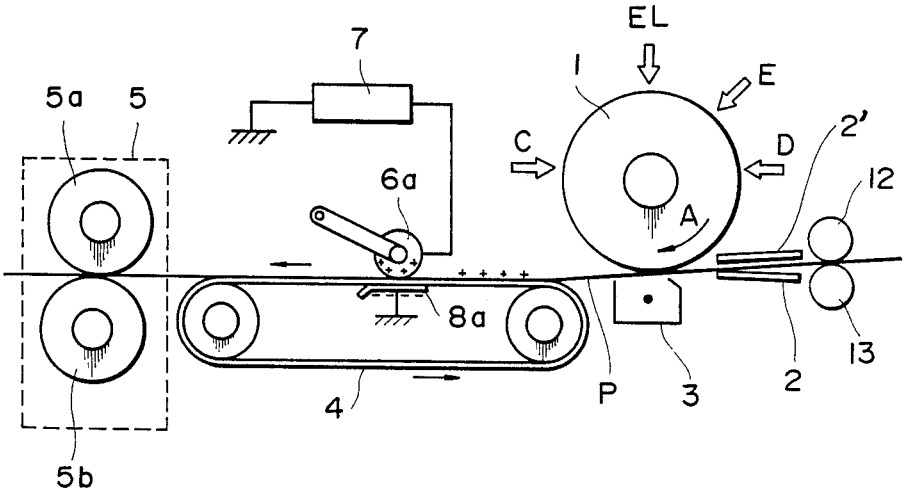
FIG. 1 is a diagrammatic side elevational view, showing in part a first preferred embodiment of an image forming apparatus in accordance with the present invention.

In the Figures, the same constitutent elements are indicated by like reference numerals for the sake of simplicity; and in the following description, reference will be made to a copying machine as an example of an image forming apparatus.

FIG. 1 is a side elevational view schematically showing a first preferred embodiment of an image forming apparatus of this invention which is incorporated in a copying machine equipped with a pressure-fixing device.

As shown, a cylindrical image carrier drum 1 is rotated in the direction of an arrow A and a transferable toner image is formed on the surface of the image carrier drum 1. A flexible, sheet-like transfer medium P, such as copying paper, is supplied through a gap between guides 2 and 2' from paper feed means (not shown), and approaches a transfer section including a transfer charger 3. In the transfer section, the toner image is transferred from the drum 1 to the transfer medium P as the medium P tangentially passes by the drum 1. The transfer medium P leaves the drum 1 and is fed leftwardly, as viewed in FIG. 1 by means of a feed belt assembly 4. Subsequently, the transfer medium P passes through a fixing section 5 including a pair of rollers 5*a* and 5*b* which are pressed against each other; and the transfer medium is then discharged from the copying machine.

As a matter of course, an electric charger EL, an exposure section E for forming an electrostatic latent image by projecting a light image onto the drum 1, a development device D for developing the latent image by applying toner to the latent image, and a cleaner C for cleaning the toner remaining on the drum 1 are disposed around the image carrier drum 1. However, since these constituent elements do not directly concern the present invention, detailed description of the elements is omitted.

Referring again to FIGS. 1 and 2, a pair of the upper-surface rollers 6*a* and 6*b* (FIG. 2) are disposed in contact with the upper surface of a feed belt assembly 4, support plates 8*a* and 8*b* are disposed on the underside of the belt assembly 4 which corresponds to the positions of the upper-surface rollers 6*a* and 6*b*, and the feed belt assembly 4 is nipped between the upper-surface rollers 6*a*, 6*b* and the support plates 8*a*, 8*b*. In order to prevent unfixed toner from sticking to the upper-surface rollers 6*a* and 6*b*, a high-voltage power source 7 applies a d.c. bias voltage of the same polarity as that of the toner to the upper-surface rollers 6*a* and 6*b*. As a method of applying a d.c. bias voltage, a d.c. voltage of the opposite polarity to that of the toner may be applied to the support plates 8*a* and 8*b* as well as the upper-surface rollers 6*a* and 6*b*. In brief, it suffices to form an electric field which generates a force acting to press the toner against the surface of the transfer medium.

Figure 2:
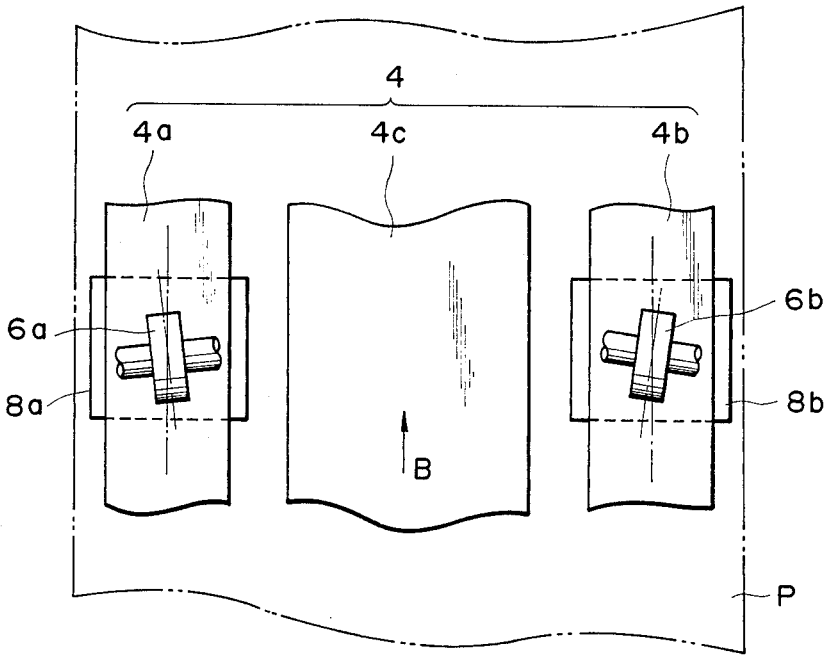
FIG. 2 is a partially enlarged, top plan view of a portion of the embodiment of FIG. 1.

Referring to FIG. 2, which is a top plan view of the intermediate guide means, the feed belt assembly 4 is constituted by a wide feed belt 4*c*, and narrow feed belts 4*a* and 4*b* disposed along both sides of the belt 4*c*. These belts are caused to travel in synchronism by a drive source (not shown) in the direction of an arrow B and the transfer medium P is also fed in the same direction. The upper-surface rollers 6*a* and 6*b* are maintained in contact with the upper surfaces of the feed belts 4*a* and 4*b*, respectively, and each of the rollers 6*a* and 6*b* forms an angle at which the rollers diverge outwardly from the direction of travel of the transfer medium P. The support plates 8a and 8b are disposed on the underside of the respective feed belts 4a and 4b so as to receive the pressure applied by the rollers 6a and 6b.

The first preferred embodiment of the image forming apparatus of the present invention is constructed in this fashion, and this embodiment will be described in more detail below.

Each of the feed belts 4a and 4b is a flat belt made of urethane rubber having a volume resistivity of approximately $10^{12}$ Ω-cm, and the feed belt 4c is also made of urethane rubber. The surface of each belt may have either a rough or a smooth finish.

The upper-surface rollers 6a and 6b comprise bearings having a width of 50 mm and a diameter of 16 mm.

A coil spring (not shown) of 300 g is employed as a means for imparting a pressing force to the upper-surface rollers 6a and 6b. The support plates 8a and 8b are made of stainless steel. A voltage of +7000V is applied by the high-voltage power source 7 to the bearing surfaces of the rollers 6a and 6b; and the toner is thereby positively charged.

Figure 9:
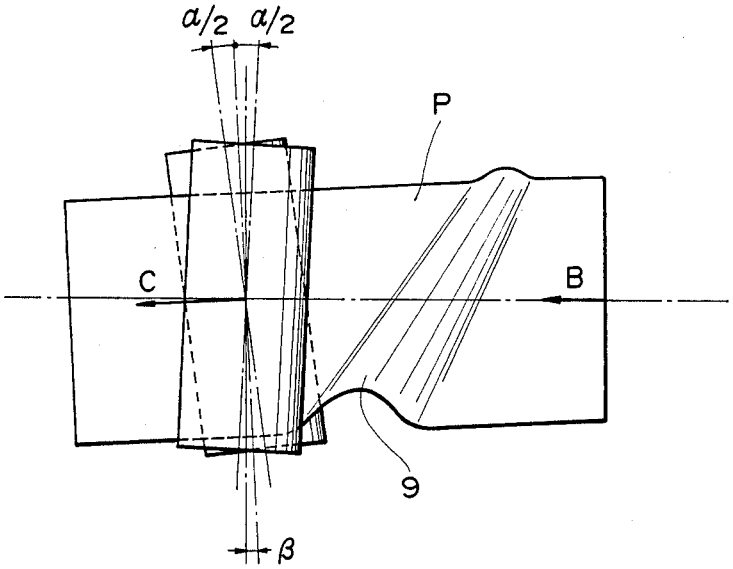
FIG. 9 PRIOR ART
FIG. 9 is a top plan view similar to FIG. 8 but showing the formation of a wrinkle in the transfer medium.
Figure 11:
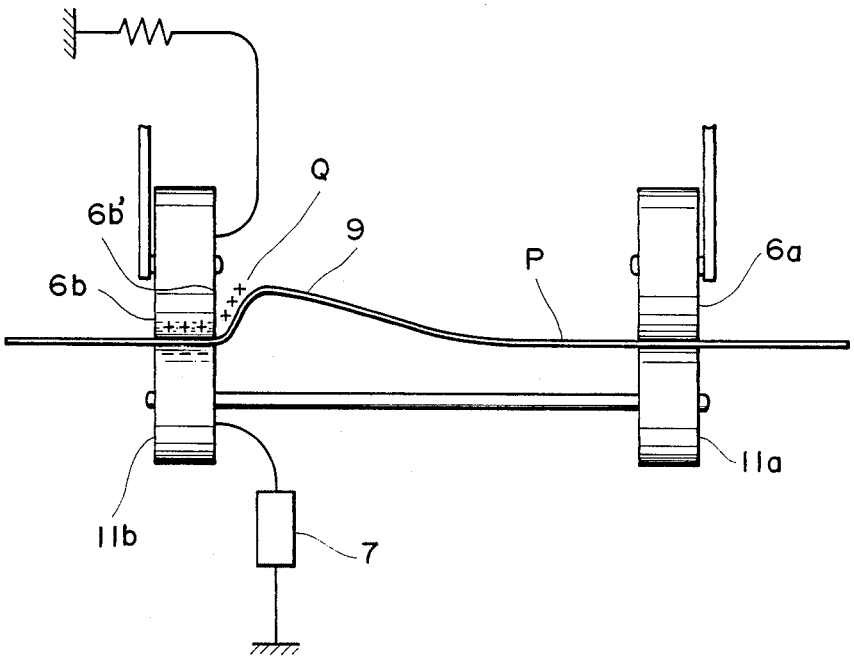
FIG. 11 PRIOR ART
FIG. 11 is a front elevational view taken along line 11—11 of FIG. 7 and showing the state wherein electric charge leaks to one side of the prior-art upper-surface roller.

According to the first embodiment having the above described construction, if the wrinkle 9 as shown in FIG. 9 occurs in the transfer medium P, the medium P is subjected to breadthwise tension caused by the upper-surface rollers 6a and 6b which, as shown in FIG. 2, are so disposed as to diverge in the direction of travel of the transfer medium P, with the result that the transfer medium P is stretched outwardly and the wrinkle 9 disappears. Hence, although the prior art involves disadvantage in that image formation is adversely affected by the wrinkle 9 reaching the transfer section, and unfixed toner, as shown in FIG. 11, sticks to the upper-surface rollers 6a and 6b, the present invention is capable of solving these problems.

Figure 10:
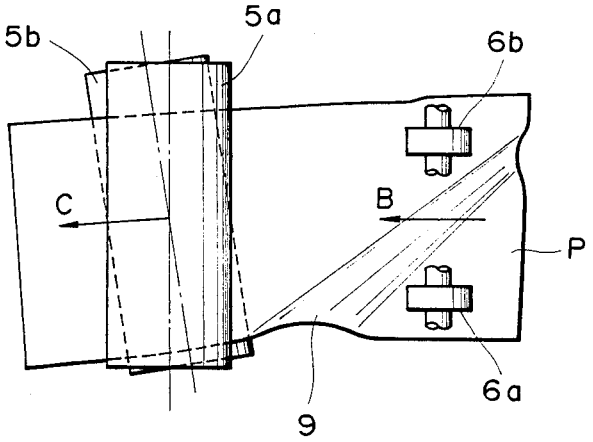
FIG. 10 PRIOR ART
FIG. 10 is a top plan view similar to FIG. 9 but showing the effect produced on a wrinkle in the transfer medium when the transfer medium passes through the space between the prior-art upper-surface rollers.

In a case where the transfer medium P, as shown in FIG. 10, is guided by parallel upper-surface rollers upon which the prior art relies, the upper-surface rollers 6a and 6b must be pressed against the transfer belts 4a and 4b with a large force in order to prevent the wrinkle 9 from reaching the transfer section. Therefore, it has heretofore been difficult to prevent unfixed toner from sticking to the upper-surface rollers 6a and 6b.

In accordance with the present invention, the wrinkle or curl 9 is effectively eliminated by imparting breadthwise tension to the transfer medium P while it is being fed, without the need to press the upper-surface rollers 6a and 6b with a large force against the transfer belts 4a and 4b.

The inventors made an experimental copy with an image forming apparatus incorporating such a feed mechanism. In their experiment, there were no difficulties such as would be caused by the deterioration of the quality of the image formed near the trailing end of the transfer medium or the toner image being partially worn by the upper-surface rollers.

The inventors carried out further experiments by varying the pressure of the upper-surface rollers 6a and 6b.

When the pressure was set below 100 g, the wrinkle of the transfer medium reached the transfer section, thereby causing transfer error.

On the other hand, when the pressure was set above 1000 g, the toner was crushed and stuck to the upper-surface rollers.

It was found that the pressure condition wherein no transfer error occurred in the transfer section and no toner was removed from the transfer medium and stuck to the upper-surface rollers ranged between 100 g and 1000 g, more preferably between 300 g and 700 g.

Secondly, when the pressure was set at 300 g, the voltage applied to the upper-surface rollers 6a and 6b was varied. It was found that there was a tendency for the toner to stick to the upper-surface rollers 6a and 6b at a voltage of 300V or less. Hence, in relation to the electric resistivity of the respective transfer belts 4a and 4b, the applied voltage is suitably made equal to or higher than 200V, more preferably within the range between 500V and 1500V.

Figure 3:
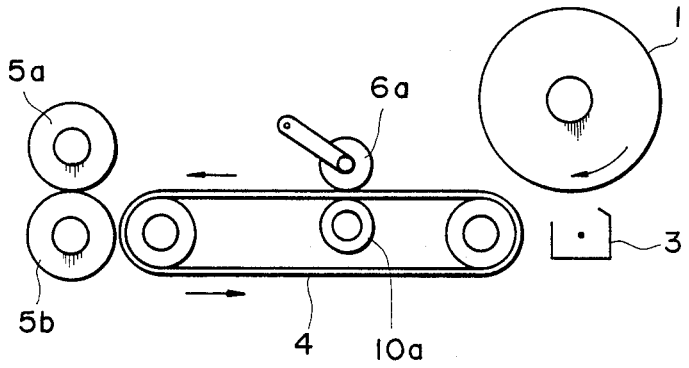
FIG. 3 is a diagrammatic side elevational view showing in part a second preferred embodiment of the present invention.

FIG. 3 shows the second preferred embodiment of the present invention, which uses an underside roller 10a as a member opposing the upper-surface roller 6a.

Figure 4:
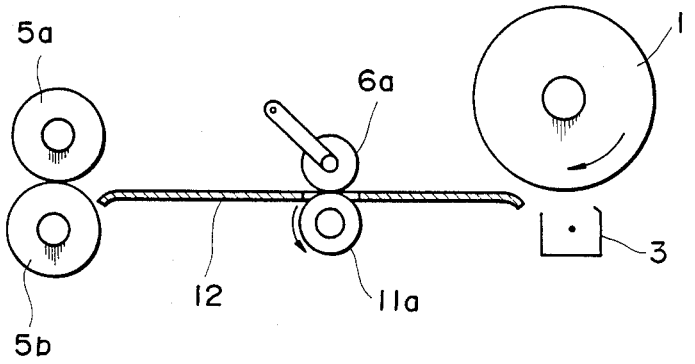
FIG. 4 is a diagrammatic side elevational view showing in part a third preferred embodiment of the present invention.

FIG. 4 shows the third preferred embodiment of the present invention which includes a guide plate 12 for guiding the transfer medium P and an underside roller 11a which extends through an opening in the plate and which is driven by a drive source (not shown) to feed the transfer medium P.

In these embodiments as well, the upper-surface rollers 6a and 6b, as shown in FIG. 2, are disposed in such a manner as to diverge in the direction of travel of the medium P.

Figure 5:
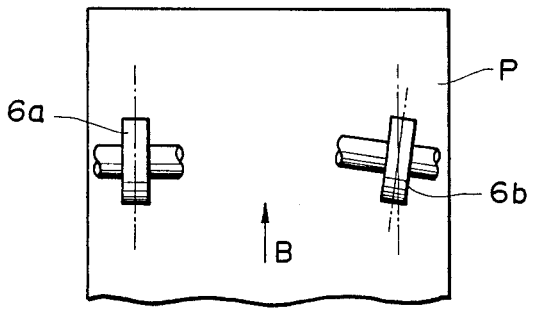
FIG. 5 is a diagrammatic top plan view showing a portion of a fourth preferred embodiment of the present invention.

Furthermore, it is not necessary to angle all of the upper-surface rollers with respect to the direction of travel of the medium P. As shown in FIG. 5, one roller may be disposed parallel with the direction of travel. It is, however, most important that the rollers are angled in such a manner as to be capable of applying breadthwise tension to the transfer medium P between the upper-surface rollers.

Figure 6:
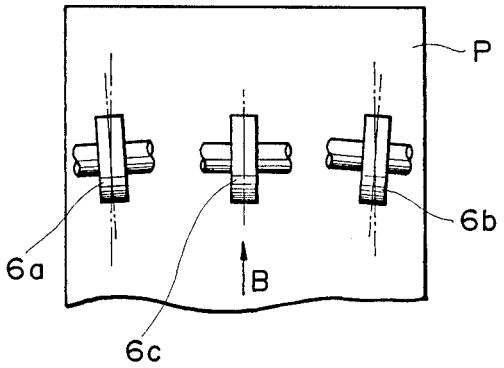
FIG. 6 is a diagrammatic top plan view showing a portion of a fifth preferred embodiment of the present invention.
Figure 7:
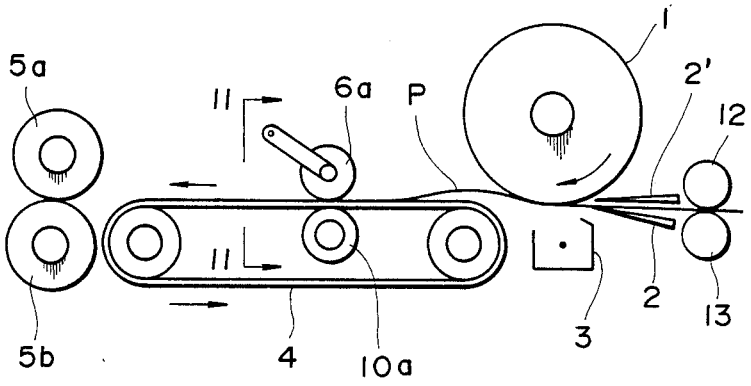
FIG. 7 PRIOR ART
FIG. 7 is a diagrammatic side elevational view showing in part an image forming apparatus according to the prior art.
Figure 8:
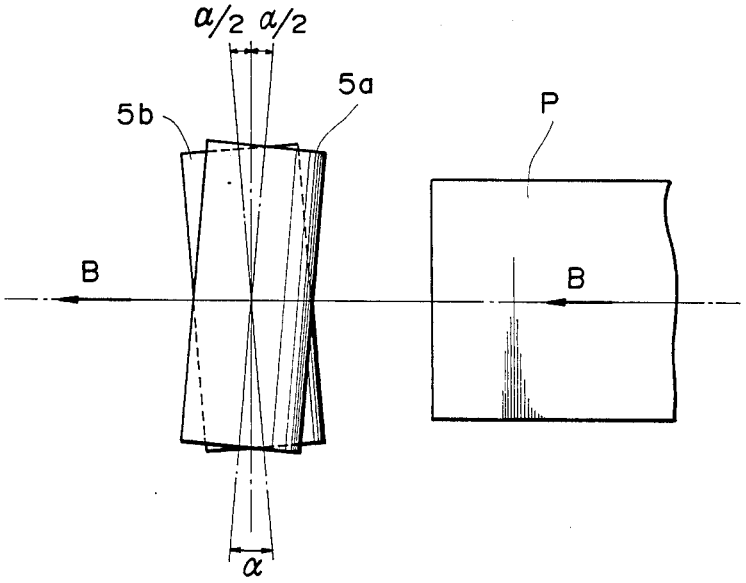
FIG. 8 PRIOR ART
FIG. 8 is a top plan view of a portion of the apparatus of FIG. 7 and showing a pair of fixing rollers and a transfer medium.

As will be readily understood from the foregoing, the number of upper-surface rollers is not limited to two, it also being possible to use three or more upper-surface rollers. In such a case as well, each roller is slanted, as shown in FIG. 6, in such a manner that tension may be applied to the respective portions of the transfer medium between the adjacent rollers.

Considering again the third embodiment shown in FIG. 4, it will be understood that not only the upper-surface roller 6a but also the underside roller 11a is capable of applying breadthwise tension to the transfer medium. In other words, if the underside roller 11a and another underside roller 11b (not shown) are disposed in such a manner as to diverge in the direction of travel of the transfer medium, it is also possible to achieve the same effect as that of each of the above-mentioned embodiments. As a matter of course, both the upper-surface rollers and the underside rollers may be disposed at an angle with respect to the direction of travel.

While the underside roller 11a is the one which is driven in the embodiment of FIG. 4, it is possible, as a matter of course, for the upper-surface roller 6a to be driven.

Furthermore, the intermediate guide means constituted as by the upper-surface rollers and the feed belt or the underside rollers needs only to guide the transfer medium so as to apply breadthwise tension to the transfer medium. Therefore, no drive source need necessarily be used to impart feeding force to the intermediate guide means.

While the above provides a full and complete disclosure of the invention, various modifications, alternative constructions and equivalents may be employed without departing from the true spirit and scope of the invention. Therefore, the above description and illustrations should not be construed as limiting the scope of the invention, which is defined by the appended claims.

What is claimed is:

1. An image forming apparatus comprising:

transfer means for transferring a toner image to a sheet-like medium;

a pair of fixing rollers which are held in pressure contact with each other such that the nip line formed therebetween does not orthogonally cross the direction of feed of said sheet-like medium, thereby to form a curl in said sheet-like medium when said sheet-like medium passes between said fixing rollers;

sheet feeding means arranged along a feed passage extending from the position of said transfer means to the position of said fixing rollers, said feeding means being capable of feeding said sheet-like medium in contact only with a first surface of said sheet-like medium; and first and second rollers disposed downstream of said transfer means and spaced apart from each other in the direction perpendicular to the direction of feed of said sheet-like medium, said first and second rollers being adapted for rotating in contact with a second surface of said sheet-like medium opposite to said first surface, said first and second rollers being arranged such that they diverge in the downstream direction so as to impart a breadthwise tension to the curl in said sheet-like medium;

wherein the second surface of said sheet-like medium is contacted only by said first and second rollers during feeding from said transfer means to said fixing rollers, and wherein the length of said feed passage extending from the position of said transfer means to the nip of said fixing rollers is shorter than the length of said sheet-like medium.

2. An image forming apparatus according to claim 1, wherein said transfer means transfers a toner image to said second surface of said sheet-like medium.

3. An image forming apparatus according to claim 1, wherein said sheet feeding means includes an opposing guide member contacting said first surface of said sheet-like medium.

4. An image forming apparatus according to claim 3, further comprising power supply means capable of applying a voltage of the same polarity as the toner of said toner image formed on said sheet-like medium to said first and second rollers.

5. An image forming apparatus according to claim 3, wherein said opposing guide members includes a conveyor belt which runs together with said sheet-like medium carried thereon.

6. An image forming apparatus according to claim 5, further comprising supporting means for supporting said conveyor belt at positions corresponding to said first and second rollers.

7. An image forming apparatus according to claim 6, wherein said supporting means includes idle rollers rotatable in accordance with the movement of said conveyor belt.

8. An image forming apparatus according to claim 6, further comprising power supply means capable of applying a voltage of the opposite polarity to the toner of said toner image formed on said sheet-like medium to said supporting means.

9. An image forming apparatus according to claim 3, wherein said opposing guide member includes a conveyor roller means which rotates in contact with said first surface of said sheet-like medium.

10. An image forming apparatus according to claim 9, wherein said conveyor roller means includes a first conveyor roller and a second conveyor roller which cooperate with said first roller and said second roller, respectively, in clamping said sheet-like medium therebetween.

11. An image forming apparatus according to claim 10, wherein said first conveyor roller and said second conveyor roller are spaced apart from each other in the direction perpendicular to the direction of feed of said sheet-like medium and are disposed such that they diverge in the downstream direction so as to impart a breadthwise tension to said sheet-like medium.

12. An image forming apparatus according to claim 1, further comprising opposing roller means rotatable in contact with said first surface of said sheet-like medium.

13. An image forming apparatus according to claim 12, wherein said opposing roller means includes a first opposing roller and a second opposing roller which are adapted for cooperating with said first roller and said second roller, respectively, in clamping said sheet-like medium therebetween.

14. An image forming apparatus comprising:

transfer means for transferring a toner image to a sheet-like medium;

a pair of fixing rollers held in pressure contact with each other and arranged such that the nip line formed therebetween extends at a predetermined angle to a line which is orthogonal to the direction of feed of said sheet-like medium, thereby to form a curl in said sheet-like medium when the sheet-like medium passes between said fixing rollers;

a sheet guide member contacting a first surface of said sheet-like medium so as to guide said sheet-like medium during feeding thereof from said transfer means to said fixing rollers;

first and second rollers disposed between said transfer means and said fixing rollers and spaced apart from each other in the direction orthogonal to the direction of feed of said sheet-like medium, said first and second rollers being rotatable in contact with a second surface of said sheet-like medium opposite to said first surface, said first and second rollers being arranged such as to diverge in the downstream direction so as to impact a breadthwise tension to the curl in said sheet-like medium; and first and second opposing rollers adapted for rotating in contact with said first surface of said sheet-like medium;

wherein the second surface of said sheet-like medium is contacted only by said first and second rollers during feeding from said transfer means to said fixing rollers, and wherein the length of said feed passage extending from the position of said transfer means to the nip of said fixing rollers is shorter than the length of said sheet-like medium.

15. An image forming apparatus according to claim 14, wherein said first and second opposing rollers are supported so as to be rotatable about axes which are orthogonal to the direction of feed of said sheet-like medium.

16. An image forming apparatus according to claim 15, wherein said first and second opposing rollers are driven so as to feed said sheet-like medium.

17. An image forming apparatus according to claim 14, wherein said first and second opposing rollers are adapted for cooperating with said first and second rollers, respectively, in clamping said sheet-like medium therebetween.

18. An image forming apparatus according to claim 14, further comprising means for applying to the surface of said first and second opposing rollers a voltage of the same polarity as the transferred toner image.

* * * * *

UNITED STATES PATENT AND TRADEMARK OFFICE

CERTIFICATE OF CORRECTION

PATENT NO. : 4,862,215

DATED : August 29, 1989

INVENTOR(S) : AKIHIRO NOMURA, ET AL.

It is certified that error appears in the above-identified patent and that said Letters Patent is hereby corrected as shown below:

COVER PAGE:

(30), "Jun. 15, 1985" should read --Jun. 18, 1985--.

COLUMN 7, line 53, "members" should read --member--.

Signed and Sealed this

Nineteenth Day of June, 1990

*Attest:*

HARRY F. MANBECK, JR.

*Attesting Officer*

*Commissioner of Patents and Trademarks*